US011306569B2

(12) United States Patent
Greci et al.

(10) Patent No.: US 11,306,569 B2
(45) Date of Patent: Apr. 19, 2022

(54) ELECTRONIC CONTROL FOR SIMULTANEOUS INJECTION AND PRODUCTION

(71) Applicant: HALLIBURTON ENERGY SERVICES, INC., Houston, TX (US)

(72) Inventors: Stephen Michael Greci, Little Elm, TX (US); Michael Linley Fripp, Carrollton, TX (US); Jyotsana Verma, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 70 days.

(21) Appl. No.: 16/636,420

(22) PCT Filed: Mar. 14, 2019

(86) PCT No.: PCT/US2019/022261

§ 371 (c)(1),
(2) Date: Feb. 4, 2020

(87) PCT Pub. No.: WO2020/185236

PCT Pub. Date: Sep. 17, 2020

(65) Prior Publication Data

US 2021/0222531 A1 Jul. 22, 2021

(51) Int. Cl.

| | |
|---|---|
| ***E21B 43/16*** | (2006.01) |
| ***E21B 43/12*** | (2006.01) |
| ***E21B 43/14*** | (2006.01) |
| ***E21B 34/14*** | (2006.01) |
| ***E21B 17/18*** | (2006.01) |

(52) U.S. Cl.
CPC ..... *E21B 43/162* (2013.01); *E21B 17/18* (2013.01); *E21B 34/14* (2013.01); *E21B 43/12* (2013.01); *E21B 43/14* (2013.01)

(58) Field of Classification Search
CPC ..... E21B 43/162; E21B 43/12; E21B 43/14; E21B 34/14; E21B 34/142; E21B 17/18
See application file for complete search history.

(56) References Cited

U.S. PATENT DOCUMENTS

| | | | | |
|---|---|---|---|---|
| 2007/0221380 | A1* | 9/2007 | Restarick | E21B 23/03 166/313 |
| 2009/0008078 | A1 | 1/2009 | Patel | |
| 2009/0065199 | A1 | 3/2009 | Patel et al. | |
| 2013/0048301 | A1 | 2/2013 | Gano et al. | |
| 2014/0166302 | A1 | 6/2014 | Patel | |
| 2016/0003017 | A1* | 1/2016 | Keller | E21B 43/162 166/250.1 |

OTHER PUBLICATIONS

International Search Report and Written Opinion; PCT Application No. PCT/US2019/022261; dated Dec. 12, 2019.

* cited by examiner

*Primary Examiner* — George S Gray
(74) *Attorney, Agent, or Firm* — Polsinelli PC

(57) ABSTRACT

A flow control device including a housing sized to be disposed within a wellbore; a valve portion disposed within the housing and operable to control the flow of fluid therethrough, the valve portion having at least one valve having a first configuration and a second configuration; an actuator operable to adjust the at least one valve between the first configuration and the second configuration; and a conduit coupled with an exterior surface of the housing and in fluidic communication with the at least one valve.

7 Claims, 6 Drawing Sheets

ELECTRONIC CONTROL FOR SIMULTANEOUS INJECTION AND PRODUCTION

CROSS-REFERENCE TO RELATED APPLICATIONS

This application is a national stage entry of PCT/US2019/022261 filed Mar. 14, 2019, said application is expressly incorporated herein in its entirety.

FIELD

The present disclosure relates generally to a system for providing simultaneous injection and production. In particular, the present disclosure relates to the use of an actuator and three-way valve to provide remote control of injection and production within a wellbore.

BACKGROUND

Wellbores are drilled into the earth for a variety of purposes including tapping into hydrocarbon bearing formations to extract the hydrocarbons for use as fuel, lubricants, chemical production, and other purposes. The oil and gas industry typically drill wellbores through multiple subterranean formations, thereby resulting in the establishment of multiple production zones at various locations along the length of the wellbore. During production, in order to control the flow of fluids into the production tubing, autonomous inflow control devices may be employed. These autonomous inflow control devices may be used to regulate the flow of fluids into the production tubing that have migrated to the wellbore from the surrounding formation.

BRIEF DESCRIPTION OF THE DRAWINGS

Implementations of the present technology will now be described, by way of example only, with reference to the attached figures, wherein.

DETAILED DESCRIPTION

Figure 1:
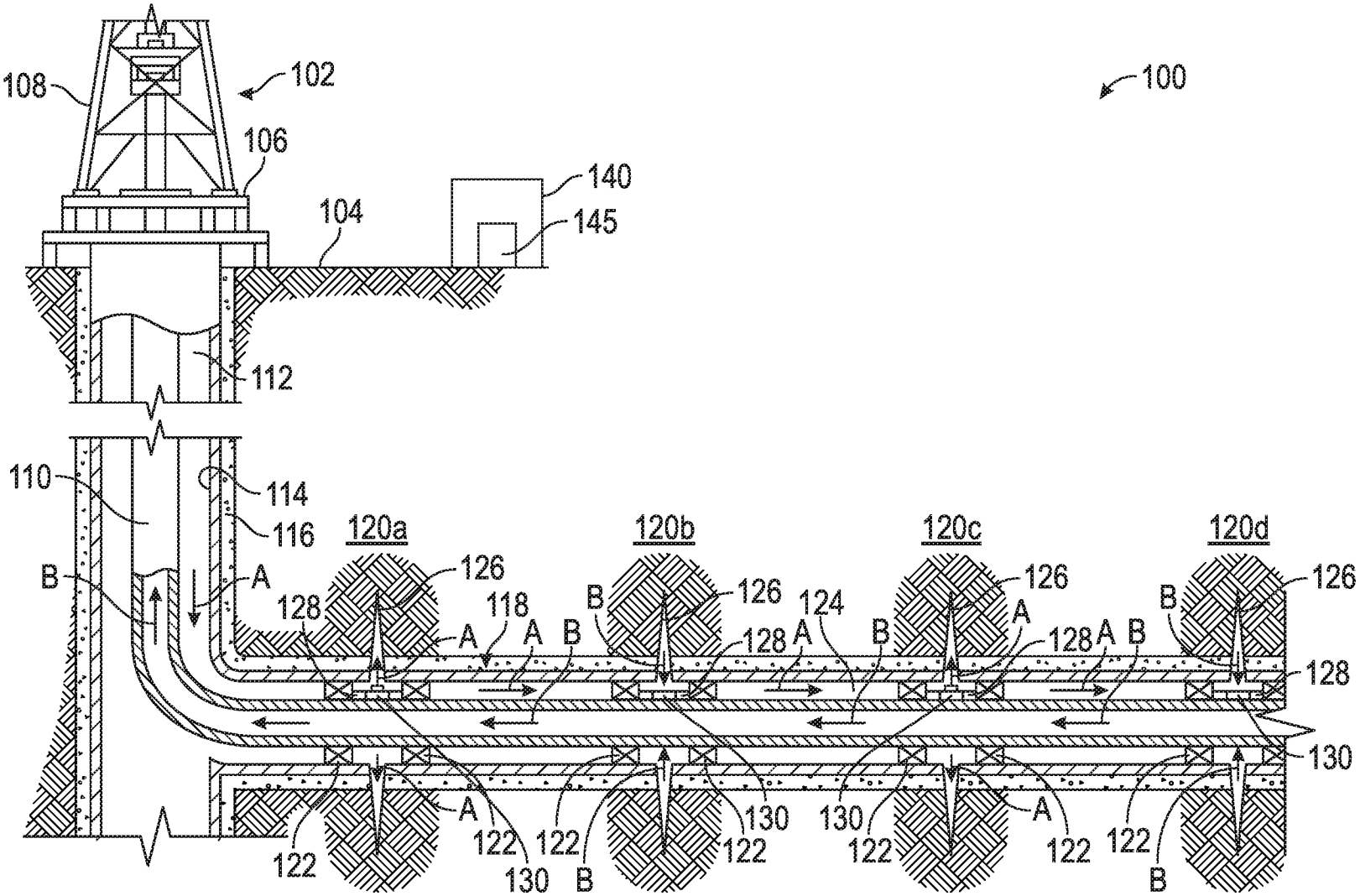
FIG. 1 is a schematic diagram illustrating an exemplary well system which can employ the methods and systems as disclosed herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Downhole equipment currently used is generally limited to either the injection of fluid from uphole or the production of downhole fluids. Specifically, fluid injection equipment is typically deployed and operated first, then removed from the wellbore to allow for production equipment to be disposed downhole. However, the efficiency of the wellbore production can be increased by allowing for simultaneous injection which can cause subterranean fluids to be pushed towards the production equipment. Disclosed herein is a method and system for remote control of a simultaneous injection/production system via a flow control device including an actuator and a three-way valve disposed within a wellbore. For example, an electronically controlled actuator can be coupled with the three-way valve and also communicatively coupled with a control or processing facility above ground in order to adjust the flow control device from an injection configuration to a production configuration. In at least one example, the electronically controlled actuator can include a motor, such as a DC motor, brushless DC motor, stepper motor, and a ball screw, or other drive component to adjust the placement of the valve.

FIG. 1 illustrates an exemplary operational wellbore system 100 that can employ the systems and methods disclosed herein. As shown, the operational wellbore system 100 can include a rig 102 located on an earth formation 104. The rig 102 may include a drilling platform 106 and a derrick 108 located on the platform 106. The derrick 108 may support or otherwise manipulate the position of tubing 110 configured to be extended into a wellbore 112 drilled into the earth formation 104. The wellbore 112 can be completed with a casing 114 secured in place using cement 116. The wellbore 112, as shown, may include a vertical portion descending directly into the earth formation 104. In at least some examples, the wellbore 112 can be a directional well, including one or more bends to create a lateral portion 118 of the wellbore 112. While FIG. 1 illustrates a wellbore 112 having a single bend, it should be understood that in other applications portions or substantially all of the wellbore 112 may be vertical, deviated, horizontal, and/or curved.

As illustrated in FIG. 1, the lateral portion 118 of the wellbore 112 can extend through various subterranean formations 120*a*,120*b*,120*c*,120*d*. Each of the subterranean formations 120*a*-120*d* can be a part of the same general subterranean formation or, in the alternative each subterranean formation 120*a*-120*d* can be a separate individual subterranean formation. The subterranean formations 120*a*-120*d* can be hydrocarbon bearing formations, in order to access and produce hydrocarbons from the wellbore 112, the tubing, such as production tubing 110, can be extended into the lateral portion 118 of the wellbore 112 such that the tubing 110 passes through each of the defined formations 120*a*-120*d*. The production tubing 110 can be secured within the lateral portion 118 of the wellbore 112 using one or more wellbore isolation devices 122. In at least one embodiment, the one or more wellbore isolation devices 112 can be a wellbore packer, a frac plug, a bridge plug, a wiper plug, a cement plug, or combinations thereof. The one or more wellbore isolation devices 122 can be configured to isolate predetermined areas of an annulus 124 defined between the production tubing 110 and the walls of the wellbore 112 or casing 114.

Various perforations 126 can be made throughout the length of the wellbore 112 which can extend through the casing 114 and cement 116 and into the surrounding subterranean formations 120*a*-120*d*. The subterranean formations 120*a*-120*d* can be subjected to treatments including, but not limited to, hydraulic fracturing, stimulation injections, gravel packing, wellbore cleanup, mud conditioning, or any other wellbore operation, in order to enhance the production of hydrocarbons within the formations. In at least one example, the wellbore isolation devices 122 can be arranged on either side of the perforations. As a result, the wellbore 112 can be effectively divided into separate formation intervals, or zones, as shown in FIG. 1. Each zone can then be stimulated or produced individually via the annulus 124 as defined between the wellbore isolation devices 122. While FIG. 1 depicts a wellbore 112 having four zones, it should be understood by those having skill in the art that any number of zones may be defined within the system 100, without departing from the scope of the disclosure.

The operational wellbore system 100 can further include one or more bypass conduits 128 that can extend axially through the production tubing 110 between the one or more wellbore isolation devices 122. The bypass conduits 128 can be used to facilitate the injection of one or more fluids from the wellbore into the adjacent subterranean formations 120*a*-120*d* via a flow control device 130 including a housing and a flow control device. In other configurations, the bypass conduits 128 can be used to allow for production fluids to be withdrawn from the subterranean formations 120*a*-120*d* and into the production tubing 110. In at least one example, a portion of the zones can be used for injection while others can simultaneously be used for production. As shown in FIG. 1, an injection fluid can be pumped into the first and third subterranean formations 120*a*,120*c*, as indicated by arrows A. The injection fluid A can originate at the surface of the earth formation 104, or at any point between the surface and the first formation 120*a*. The injection fluid can be pumped into the subterranean formations 120*a*,120*c* via the annulus 124 as described above. In at least one example, the injection fluid is operable to push hydrocarbons toward the subterranean formations configured for production, in the present example subterranean formations 120*b*,120*d*. The hydrocarbons can then be drawn from subterranean formations 120*b*,120*d* into the production tubing 110 through flow control device 130, as shown by arrow B. Once the produced fluids enter the production tubing 110, the fluids can be produced to the surface of the earth formation 104 via the rig 102. The flow control device 130 further includes an actuator which can switch the three-way valve from a first configuration to a second configuration in response to a communication from a computing device 145 located in a control or processing facility 140, as described in greater detail below. While the valve of the flow control device 130 is described as including a three-way valve, it should be recognized that a pair of two-way valves coupled to one another could be used to achieve the same results. In at least one example, the flow can be switched from an injection flow to a production flow. In an alternative example, the flow can be switched from a production flow to an injection flow.

Modifications, additions, or omissions may be made to FIG. 1 without departing from the spirit and scope of the present disclosure. For example, FIG. 1 depicts components of the operational wellbore system 100 in a particular configuration. However, any suitable configuration of components may be used. Furthermore, fewer components or additional components beyond those illustrated may be included in the operational wellbore system 100 without departing from the spirit and scope of the present disclosure. It should also be noted that while FIG. 1 generally depicts a land-based operation, those skilled in the art would readily recognize that the principles described herein are equally applicable to operations that employ floating or sea-based platforms and rigs, without departing from the scope of the disclosure.

Figure 2:
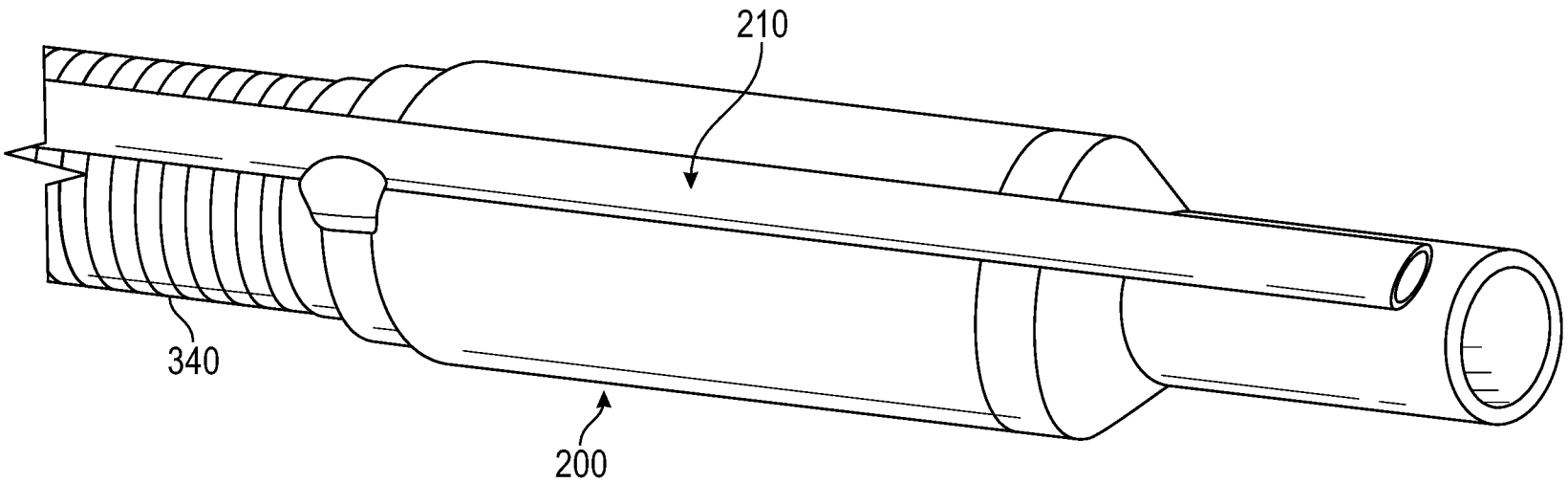
FIG. 2 is a diagram illustrating an exemplary flow control device which can be used with the methods and systems disclosed herein.
Figure 3A:
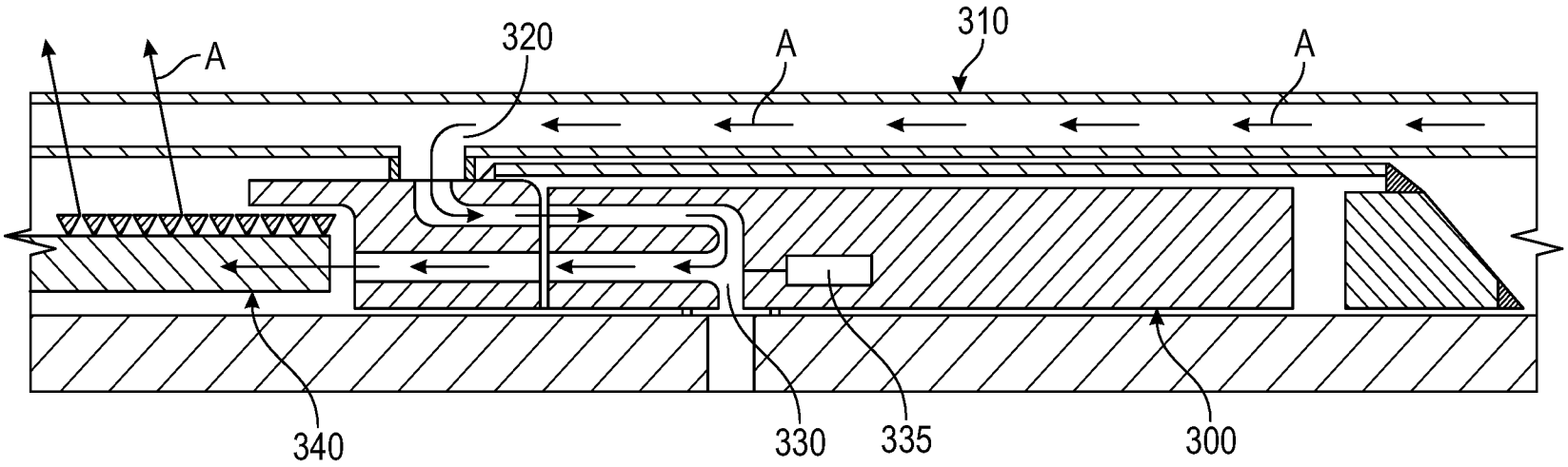
FIG. 3A is a cross-sectional diagram illustrating a flow control device and injection conduit in a first position.
Figure 3B:
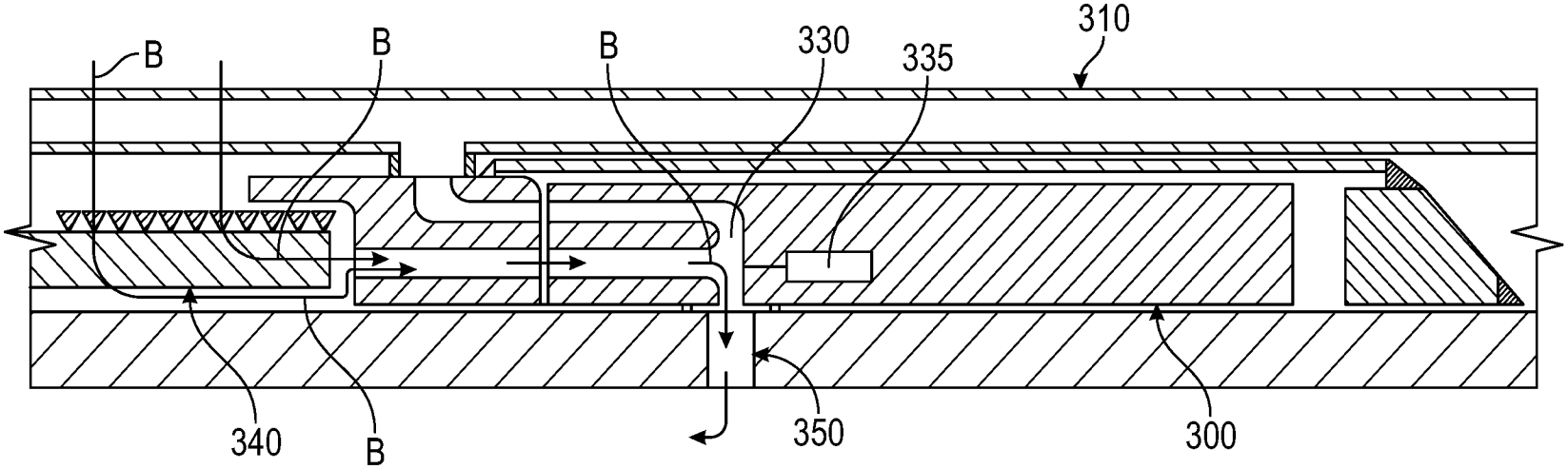
FIG. 3B is a cross-sectional diagram illustrating a flow control device and injection conduit in a second position.

An exemplary flow control device 200 compatible with the systems and methods described herein is shown in FIG. 2. In at least one example, the flow control device can be fluidically coupled with a conduit 210, such as a bypass conduit. The conduit 210 can be used to allow fluids to bypass mechanisms within the flow control device during certain processes. For example, the conduit 210 can be used to bypass certain unnecessary elements of the flow control device during an injection operation. Cross-sectional views of the flow control device and conduit are shown in FIGS. 3A and 3B. Specifically, FIG. 3A illustrates a cross-sectional view of an exemplary flow control device including a housing 300 and a valve portion 330, illustrated as a three-way valve, the housing 300 coupled with a conduit 310 and the flow control device configured to perform an injection operation. As shown, a fluid can be pumped downhole through the conduit 310 and into the flow control device housing 300 via junction 320. In at least one example, the fluid can be an injection fluid. In at least one example, the injection fluid can be a Newtonian fluid or a non-Newtonian fluid (such as a polymer). For example, the injection fluid can be, but is not limited to, water, steam, carbon dioxide, brine, hydrocarbons, nitrogen, or any other suitable fluid. The fluid can be pumped from the conduit through the valve portion 330, wherein the valve portion is set to a first configuration. In at least one embodiment, the valve flow can be controlled by an electronically controlled actuator 335. The electronically controlled actuator 335 may include an electric motor such as a DC motor, brushless DC motor, stepper motor, along with a drive component such as a ball screw or lead screw. In an alternative embodiment, the valve flow can be controlled by a timer coupled with the actuator. In another alternative embodiment, the valve can be self-powered. For example, the valve can be can be powered by a flow harvester which can be operable to convert flow energy into electrical energy (such as a using a turbine). In yet another alternative embodiment, the valve can be powered via a battery, such as a chemical battery. In the present example, the first configuration is an injection mode. The fluid can be pumped through a screen 340 prior to being injected into the surrounding subterranean formations, as shown in FIG. 1. In the present example, the flow of the fluid is indicated by arrows A.

In addition to injection, the present system and methods can be used in a production operation, an example of which is shown in FIG. 3B. Fluid, indicated by arrows B, is drawn from the surrounding subterranean formations into the screen 340 through the valve portion 330, via actuator 335, to a second configuration. In the present example, the second configuration is a production mode. The fluid can then go through bypass 350 and enter production tubing, as shown and described with respect to FIG. 1. The valve portion 330, illustrated as the three-way valve, described herein can be electronically controlled via actuator 335 to switch between the first configuration and the second configuration. The valve can be controlled via wired or wireless communications received from a control or processing facility. While the valve portion 330 is described as a three-way valve in FIGS. 3A and 3B, it should be understood that a set of two-way valves can be coupled together to achieve the same operations. For example, a first valve can be used when the flow control device is in an injection configuration and a second valve can be used when the flow control device is in a production configuration. While FIGS. 3A and 3B illustrate a single flow control device and three-way valve it should be readily understood by those having skill in the art that multiple systems can be used in sequence as shown in FIG. 1. Examples illustrating the use of multiple systems in sequence within a wellbore are shown in FIGS. 4A-4C.

Figure 4A:
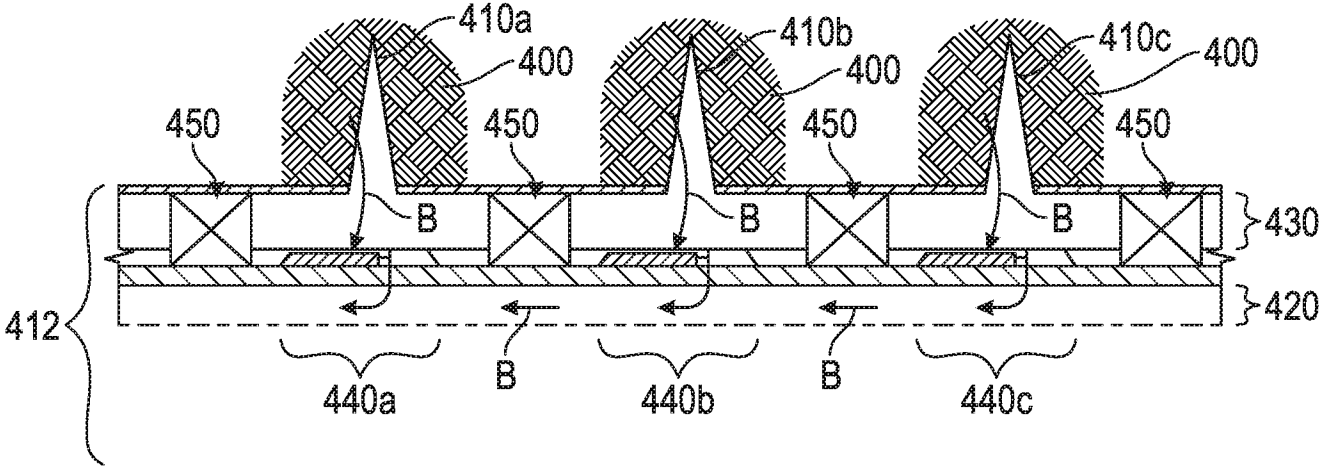
FIG. 4A-4C is a diagram illustrating a system multiple flow control devices disposed within a wellbore.

FIG. 4A illustrates an earth formation 400 having three perforations 410*a*,410*b*,410*c* made from the wellbore 412 into the subterranean formation 400 surrounding the wellbore. The wellbore 412 can include at least a length of production tubing 420 and a conduit 430 running along the length of the production tubing 420 and separated from the subterranean formation 400 by a casing 435. One or more wellbore isolation devices 450 can be deployed within the wellbore 412 in order to isolate the perforated 410*a*-410*c* sections of the subterranean formation 400. A flow control system can be located between each set of wellbore isolation devices 450, and aligned with each of the perforations 410*a*-410*c*. In the present example, three flow control systems 440*a*,440*b*,440*c* are shown, along with three perforations 410*a*-410*c*. Based on the three-way valve setting, the flow control systems 440*a*-440*c* can be switched between an injection mode and a production mode, as described in more detail with respect to FIGS. 3A and 3B. As shown, each of the three injection/product systems 440*a*-440*c* of FIG. 4A are configured for production, drawing hydrocarbons from the earth formation through the injection/production system 440*a*-440*c* and into the production tubing 420, as shown by Arrows B.

Figure 4B:
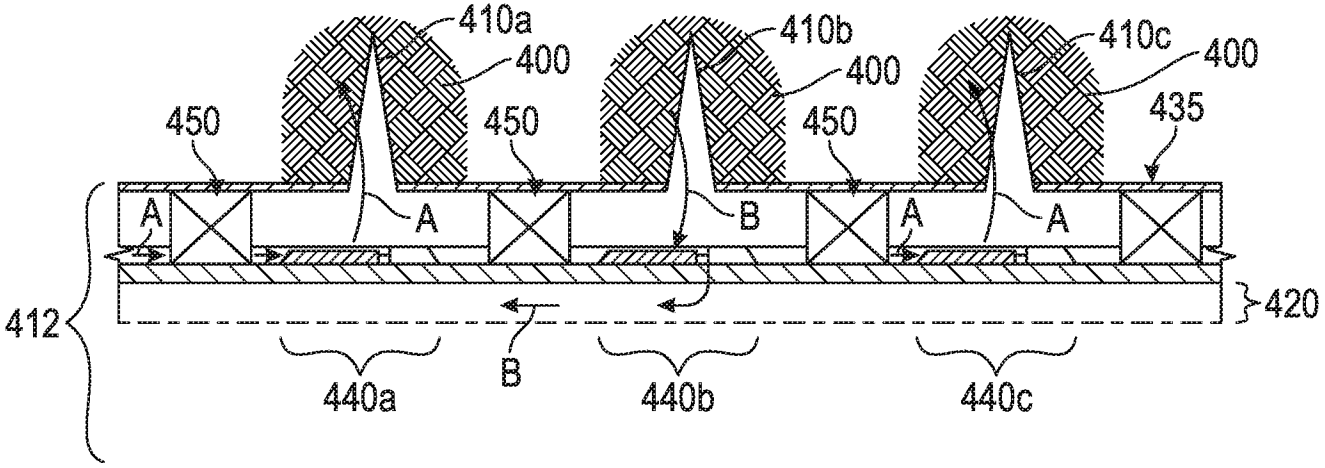

An alternative example is shown in FIG. 4B, wherein the outer two injection/production systems 440*a*,440*c* are configured to inject the surrounding earth formation 400 with an injection fluid, illustrated by Arrows A. The injection fluid can be any fluid suitable for modifying the surrounding formation in the desired manner including, but not limited to, water, steam, carbon dioxide, brine, hydrocarbons, and nitrogen. The injection fluid can be configured to increase the pressure within the surrounding earth formation 400 in order to stimulate production in a nearby portion of the wellbore 412. As shown, an injection fluid can be pumped into the two outer two perforations 410*a*,410*c* while produced fluids can be drawn in through the central perforation 410*b*, as indicated by Arrows B. As shown in FIG. 4B, the injection/production systems 440*a*-440*c* can allow for fluids to be injected into the formation and produced from the formation simultaneously. Simultaneous injection and production can provide several advantages over the standard production process. For example, a greater ultimate recovery can be made possible using the disclosed injection/production system by allowing a greater percentage of the in situ hydrocarbons to be produced. The injection fluid can be used to sweep the in situ hydrocarbons from their original location into the production zone. For example, in a heavy oil reservoir, an injection fluid, such as steam, can help to reduce the viscosity of the oil in the surrounding formation. Injecting steam into the wellbore can help ensure that the oils produced retain the lower viscosity. In another example, an injection fluid can be used to hydraulically fracture a low permeability formation, while simultaneously extracting a production fluid from the formation.

Figure 4C:
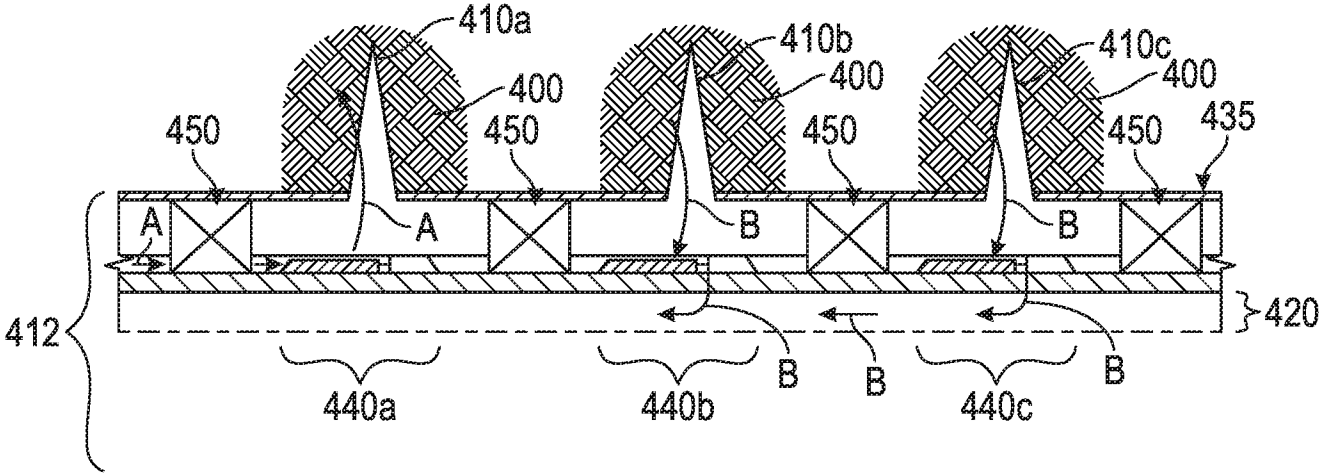

A third example is illustrated in FIG. 4C. The third example illustrates the first injection/production system 440*s* in an injection mode pumping fluid into perforation 410*a*, while the second and third injection/production systems 440*b*,440*c* are in a production mode extracting hydrocarbons from the remaining perforations 410*b*,410*c*. It should be readily apparent to those having skill in the art that each of the injection/production systems 440*a*-440*c* as shown in FIGS. 4A-4C can be switched from an injection mode to a production mode in response to a communication received from the control or processing facility.

In at least one example, a sensor can be coupled with the flow control device. The sensor can be operable to monitor one or more downhole parameters. In addition, the sensor can be communicatively coupled, via wired or wireless communication, with the control or processing facility as described above. The sensor can be operable to send and receive signals therefrom. For example, during stimulation, a sensor can be operable to detect whether the injection fluid is breaking through to the desired production zone. The data collected via the sensor can then be used to adjust the valve. For example, based on the data collected, a valve opening in the injection configuration can be reduced, while a valve opening in the production configuration can be increased to allow for increased production.

Figure 5:
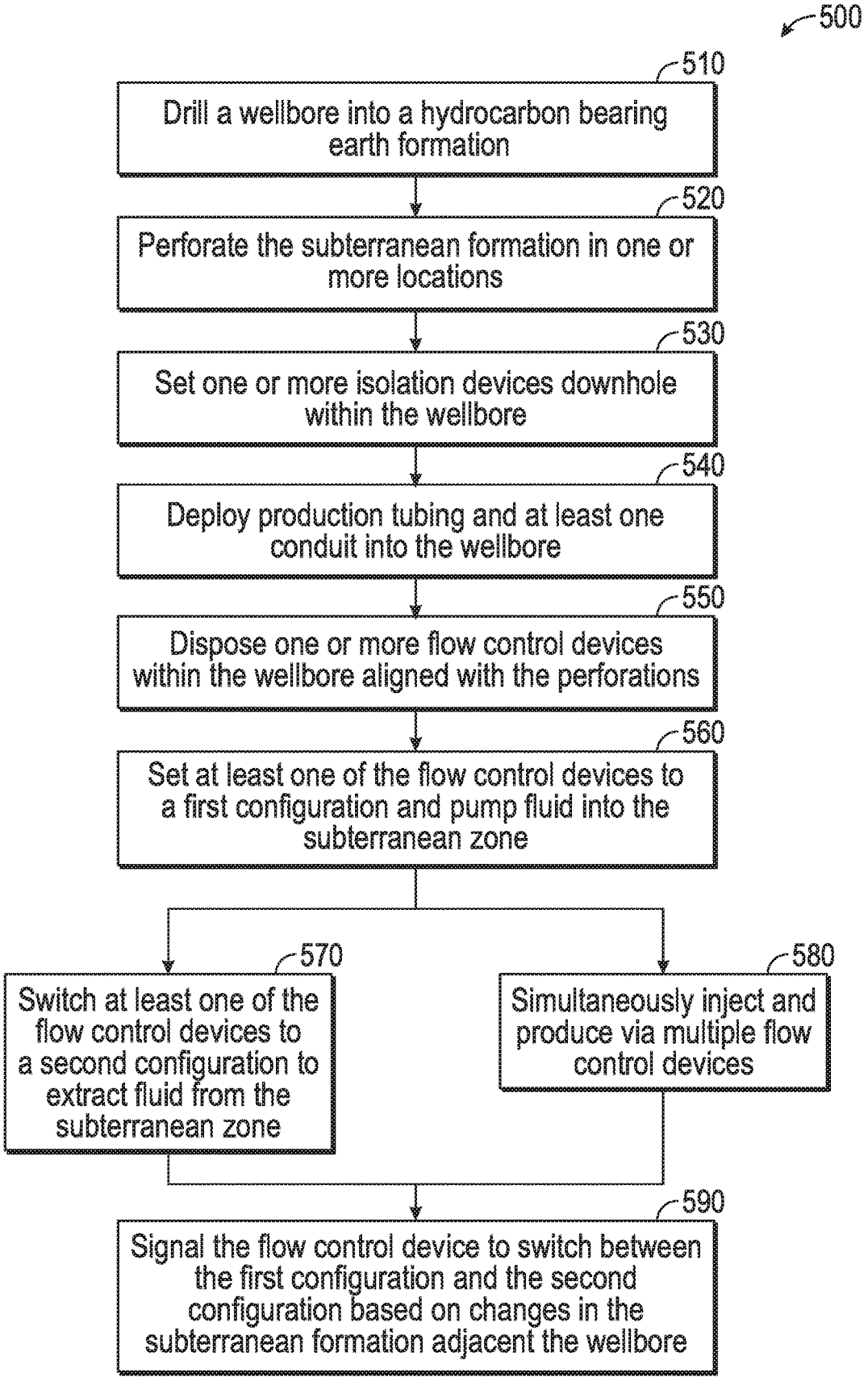
FIG. 5 is a flow chart illustrating a method for remote controlling of injection and production within a wellbore.

A method 500 for electronically controlling the flow of fluids within a wellbore as described above is shown in FIG. 5. The method can begin at block 510 wherein a wellbore is drilled into a hydrocarbon bearing earth formation. As described in detail above, the wellbore can be of any orientation necessary to pass through one or more hydrocarbon bearing formations within the subterranean formation. At block 520, one or more perforations can be made within the subterranean formation. In at least one example, a perforation can be made in each area believed to be a hydrocarbon bearing zone. In an alternative example or in addition to the above, a perforation can be made in an area adjacent to an area believed to be a hydrocarbon bearing zone.

At block 530, multiple wellbore isolation devices can be deployed into the wellbore and secured on either side of each of the perforations. As such, each set of wellbore isolation devices can create a subterranean zone for the injection and/or extraction of fluids. At block 540, production tubing and a conduit can be deployed into the wellbore. The downhole equipment can be arranged such that the production tubing and conduit extend past each of the subterranean zones created by the wellbore isolation devices. At block 550, one or more flow control devices can be disposed within the wellbore. Each of the flow control devices can be positioned such that one flow control device aligns with each of the subterranean zones. As described above, each of the flow control devices can include a valve portion, such as at least a three-way valve, and an actuator communicable with a control or processing facility above ground. The three-way valve can be adjusted via the actuator to control the flow of fluids though the flow control device. As described in detail above, the actuator can be either wired or wirelessly powered.

At block 560, at least one of the flow control devices can be set to a first configuration. In the present example, the first configuration can be an injection configuration, wherein the three-way valve is arranged to allow for fluid to be pumped into the surrounding subterranean zone. In at least one example, each of the flow control devices within the wellbore can be set to the first configuration, pumping fluid into each of the perforations. After the desired amount of fluid is pumped into the subterranean formation, at block 570 at least one of the flow control devices can be switched via the actuator to a second configuration. In the present example, the second configuration can be a production configuration, wherein the three-way valve is arranged to allow for fluid to be extracted from the subterranean zone and drawn into the production tubing.

In an alternative example, if only a portion of the flow control devices are set to the first configuration, at block 580 the remaining flow control devices can be set to a second configuration. As described above, the second configuration can be a production configuration, wherein the three-way valve is arranged to allow for fluid to be extracted from the subterranean zone. As such, the flow control devices can simultaneously inject and extract fluids into the subterranean zones adjacent the wellbore, as shown in FIGS. 4B and 4C.

As described above, the position of the three-way valve within the flow control devices can switch between an injection configuration and a production configuration. At block 590, the flow control device can switch between an injection configuration and a production configuration throughout the life of the wellbore as the subterranean formation changes. For example, as hydrocarbons are extracted from certain subterranean zones, flow control devices at particular locations can be signaled to enter an injection configuration in order to push remaining hydrocarbons from the subterranean formation to the zones where the flow control devices are in the production configuration. The ability to switch between an injection configuration and a production configuration as the subterranean formation surrounding the wellbore changes can allow for a more efficient extraction of hydrocarbons.

Numerous examples are provided herein to enhance understanding of the present disclosure. A specific set of statements are provided as follows.

Statement 1: A flow control device comprising a housing sized to be disposed within a wellbore; a valve portion disposed within the housing and operable to control the flow of fluid therethrough, the valve portion comprising at least one valve having a first configuration and a second configuration; an actuator operable to adjust the at least one valve between the first configuration and the second configuration; and a conduit coupled with an exterior surface of the housing and in fluidic communication with the at least one valve.

Statement 2: A flow control device in accordance with Statement 1, wherein the first configuration of the at least one valve is an injection configuration operable to pump one or more fluids from the conduit, through the at least one valve, and into a formation adjacent the wellbore.

Statement 3: A flow control device in accordance with Statement 1, wherein the second configuration is a production configuration operable to extract one or more production fluids from a formation adjacent the wellbore.

Statement 4: A flow control device in accordance with Statements 1-3, wherein the valve is selected from the group comprising a three-way valve and a plurality of two-way valves.

Statement 5: A flow control device in accordance with Statements 1-4, wherein the at least one valve is a three-way valve, wherein the first configuration is an injection configuration operable to pump one or more fluids from the conduit and into a formation adjacent a wellbore via the three-way valve, and wherein the second configuration is a production configuration operable to extract one or more production fluids from a formation adjacent the wellbore and into the housing via the three-way valve.

Statement 6: A flow control device in accordance with Statements 1-4, wherein the at least one valve is a series of valves coupled with one another including a first valve for use in the first configuration; and a second valve for use in the second configuration.

Statement 7: A flow control device in accordance with Statements 1-6, wherein the actuator is self-powered.

Statement 8: A flow control device in accordance with Statements 1-6, wherein the actuator is either wired or wirelessly powered.

Statement 9: A flow control device in accordance with Statements 1-6, wherein the valve is powered via a flow harvester.

Statement 10: A flow control device in accordance with Statements 1-6, wherein the valve is powered via a battery.

Statement 11: A flow control device in accordance with Statements 1-10, wherein the actuator includes a motor and a ball screw.

Statement 12: A flow control device in accordance with Statements 1-11, further comprising a screen disposed within the housing and communicable with the at least one valve.

Statement 13: A method for controlling wellbore operations comprising perforating a subterranean formation adjacent a wellbore at one or more predetermined locations; disposing a length of production tubing and a conduit into the wellbore; deploying one or more flow control devices within the wellbore, the one or more flow control devices comprising a housing sized to be disposed between the subterranean formation and the production tubing; and a valve portion disposed within the housing and operable to control the flow of fluid therethrough, the valve portion comprising at least one valve having a first configuration and a second configuration, and an actuator operable to adjust the at least one valve between the first configuration and the second configuration, wherein an exterior surface of the housing is coupled with the conduit providing fluidic communication therethrough; indicating, via the actuator, at least one of the flow control devices to enter a first configuration.

Statement 14: A method in accordance with Statement 13, wherein the first configuration of the at least one valve is an injection configuration operable to pump one or more fluids from the conduit, through the at least one valve, and into a formation adjacent the wellbore.

Statement 15: A method in accordance with Statement 13 or Statement 14, further comprising aligning the one or more flow control devices with the one or more predetermined locations within the wellbore; and pumping an injection fluid through the conduit into at least one of the one or more flow control devices and into the predetermined locations within the wellbore via the valve portion.

Statement 16: A method in accordance with Statements 13-15, further comprising indicating, via the actuator, at least one of the flow control devices to enter the second configuration, wherein the second configuration is a production configuration operable to extract one or more production fluids from a formation adjacent the wellbore.

Statement 17: A method in accordance with Statement 13-16, further comprising extracting one or more production fluid from the subterranean formation adjacent the well into the housing and uphole via the production tubing.

Statement 18: A method in accordance with Statements 13-17, wherein the first configuration is a production configuration and the second configuration is an injection configuration.

Statement 19: A method in accordance with Statements 13-18, further comprising simultaneously pumping one or more fluids into the subterranean formation via at least one flow control device and extracting one or more production fluids from the subterranean formation via another of the one or more flow control devices.

Statement 20: A method in accordance with Statements 13-19, wherein each of the one or more flow control devices are signaled to enter the first configuration and pumping an injection fluid through the conduit into each of the one or more flow control devices and into each of the predetermined locations within the wellbore via the valve portion.

Statement 21: A method in accordance with Statements 13-20, further comprising signaling, via the actuator, each of the one or more flow control devices to enter a second configuration wherein the second configuration is a production configuration operable to extract one or more production fluids from the subterranean formation adjacent the wellbore; and extracting one or more production fluids from the subterranean formation adjacent the well into the housing of each of the flow control devices and uphole via the production tubing.

Statement 22: A method in accordance with Statements 13-21, wherein the valve is selected from the group comprising a three-way valve and a plurality of two-way valves.

Statement 23: A method in accordance with Statements 13-22, wherein the at least one valve is a three-way valve, wherein the first configuration is an injection configuration operable to pump one or more fluids from the conduit and into a formation adjacent a wellbore via the three-way valve, and wherein the second configuration is a production configuration operable to extract one or more production fluids from a formation adjacent the wellbore and into the flow control device via the three-way valve.

Statement 24: A method in accordance with Statements 13-23, wherein the at least one valve is a series of valves coupled with one another including a first valve for use in the first configuration; and a second valve for use in the second configuration.

Statement 25: A method in accordance with Statements 13-24, wherein the actuator is self-powered.

Statement 26: A method in accordance with Statements 13-25, wherein the actuator is either wired or wirelessly powered.

Statement 27: A method in accordance with Statements 13-26, wherein the valve is powered via a flow harvester.

Statement 28: A method in accordance with Statements 13-27, wherein the valve is powered via a battery.

Statement 29: A method in accordance with Statements 13-28, wherein the actuator includes a motor and a ball screw.

Statement 30: A wellbore environment comprising a length of production tubing disposed within a wellbore and a conduit adjacent to and running along the length of production tubing; one or more flow control devices disposed at predetermined intervals within the wellbore, the flow control devices comprising a housing sized to be disposed between the subterranean formation and the production tubing; and a valve portion disposed within the housing and operable to control the flow of fluid therethrough, the valve portion comprising a three-way valve having a first configuration and a second configuration, and an actuator coupled with the three-way valve and operable to adjust the three-way valve between the first configuration and the second configuration, wherein an exterior surface of the housing is coupled with the conduit providing fluidic communication therethrough; a control facility communicatively coupled with the actuator of the one or more flow control devices.

Statement 31: A wellbore environment in accordance with Statement 30, wherein the actuator of the one or more flow control devices is operable to switch the three-way valve from the first configuration to the second configuration, wherein the first configuration of the three-way valve is an injection configuration operable to pump one or more fluids can be from the conduit, through the three-way valve, and into a formation adjacent the wellbore, and wherein the second configuration is a production configuration operable to extract one or more production fluids from a formation adjacent the wellbore.

Statement 32: A wellbore environment in accordance with Statement 30 and Statement 31, further comprising one or more wellbore isolation devices operable to be deployed within the wellbore, wherein each of the one or more wellbore isolation devices is set adjacent to and on either side of at least one of the one or more flow control devices.

Statement 33: A wellbore environment in accordance with Statements 30-32, wherein the actuator is self-powered.

Statement 34: A wellbore environment in accordance with Statements 30-33, wherein the actuator is either wired or wirelessly powered Statement 35: A wellbore environment in accordance with Statements 30-34, wherein the valve is powered via a flow harvester.

Statement 36: A wellbore environment in accordance with Statements 30-35, wherein the valve is powered via a battery.

Statement 37: A wellbore environment in accordance with Statements 30-36, wherein the actuator includes a motor and a ball screw.

Statement 38: A wellbore environment in accordance with Statements 30-37, wherein the one or more wellbore isolation devices is selected from the group consisting of a wellbore packer, a frac plug, a bridge plug, a wiper plug, a cement plug, and combinations thereof.

Statement 39: A wellbore environment in accordance with Statements 30-38, further comprising a computing device communicatively coupled with the control facility, the computing device further comprising at least one processor and a memory storing instructions thereof executable by the at least one processor to control, via the three-way valve, the flow of one or more fluids pumped from the conduit through the one or more flow control devices and into the wellbore; and switch, via the actuator, the three-way valve between the first configuration and the second configuration.

Statement 40: A wellbore environment in accordance with Statements 30-39, wherein the instructions further cause the processor to simultaneously inject one or more fluids through one of the one or more flow control devices and extract one or more production fluids through another of the one or more flow control devices.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A method for controlling wellbore operations comprising:

perforating a subterranean formation adjacent a wellbore at one or more predetermined locations;

disposing a length of production tubing and a conduit into the wellbore;

deploying one or more flow control devices within the wellbore, the one or more flow control devices comprising:

a housing sized to be disposed between the subterranean formation and the production tubing; and a valve portion disposed within the housing and operable to control the flow of fluid therethrough, the valve portion comprising at least one valve having a first configuration and a second configuration, and an actuator operable to adjust the at least one valve between the first configuration and the second configuration, wherein an exterior surface of the housing is coupled with the conduit providing fluidic communication therethrough said housing and said conduit;

indicating, via the actuator, at least one of the flow control devices to enter a first configuration;

signaling each of the one or more flow control devices to enter the first configuration; and pumping an injection fluid through the conduit into each of the one or more flow control devices and into each of the predetermined locations within the wellbore via the at least one valve.

2. The method of claim 1, wherein the first configuration of the at least one valve is an injection configuration operable to pump one or more fluids from the conduit, through the at least one valve, and into a formation adjacent the wellbore.

3. The method of claim 2, further comprising:

aligning the one or more flow control devices with the one or more predetermined locations within the wellbore; and pumping an injection fluid through the conduit into at least one of the one or more flow control devices and into the predetermined locations within the wellbore via the at least one valve.

4. The method of claim 3, further comprising indicating, via the actuator, at least one of the flow control devices to enter the second configuration, wherein the second configuration is a production configuration operable to extract one or more production fluids from a formation adjacent the wellbore.

5. The method of claim 4, further comprising extracting one or more production fluids from the subterranean formation adjacent the well into the housing and uphole via the production tubing.

6. The method of claim 4, further comprising simultaneously pumping one or more fluids into the subterranean formation via at least one flow control device and extracting one or more production fluids from the subterranean formation via another of the one or more flow control devices.

7. The method of claim 1, further comprising: signaling, via the actuator, each of the one or more flow control devices to enter a second configuration, wherein the second configuration is a production configuration operable to extract one or more production fluids from the subterranean formation adjacent the wellbore; and extracting one or more production fluids from the subterranean formation adjacent the well into the housing of each of the flow control devices and uphole via the production tubing.

* * * * *